US008533063B2

(12) United States Patent
Erickson

(10) Patent No.: US 8,533,063 B2
(45) Date of Patent: Sep. 10, 2013

(54) METHODS AND SYSTEM FOR MAKING A PROJECT AVAILABLE FOR BIDDING TO A PLURALITY OF QUALIFIED POTENTIAL BIDDERS

(75) Inventor: Warren D. Erickson, Suwanee, GA (US)

(73) Assignee: Alacrity Renovation Services, LLC, Eugene, OR (US)

( * ) Notice: Subject to any disclaimer, the term of this patent is extended or adjusted under 35 U.S.C. 154(b) by 657 days.

(21) Appl. No.: 12/228,883

(22) Filed: Aug. 15, 2008

(65) Prior Publication Data

US 2010/0042556 A1 Feb. 18, 2010

(51) Int. Cl.
*G06Q 30/00* (2012.01)

(52) U.S. Cl.
USPC ..... 705/26.4; 705/26.35; 705/26.41

(58) Field of Classification Search
USPC ..... 705/26.1–27.2, 80
See application file for complete search history.

(56) References Cited

U.S. PATENT DOCUMENTS

| | | | | |
|---|---|---|---|---|
| 6,922,701 | B1 * | 7/2005 | Ananian et al. | 1/1 |
| 2002/0065763 | A1 * | 5/2002 | Taylor et al. | 705/37 |
| 2002/0147674 | A1 * | 10/2002 | Gillman | 705/37 |
| 2002/0161608 | A1 * | 10/2002 | Loveland | 705/4 |
| 2003/0061104 | A1 * | 3/2003 | Thomson et al. | 705/26 |
| 2004/0167789 | A1 * | 8/2004 | Roberts et al. | 705/1 |
| 2004/0186763 | A1 * | 9/2004 | Smith | 705/9 |
| 2004/0267630 | A1 * | 12/2004 | Au et al. | 705/26 |
| 2006/0200659 | A1 * | 9/2006 | Gillum | 713/151 |
| 2006/0277152 | A1 * | 12/2006 | Hirotsune | 705/80 |
| 2007/0073610 | A1 * | 3/2007 | Marugabandhu et al. | 705/37 |
| 2008/0221964 | A1 * | 9/2008 | Berkovitz et al. | 705/9 |
| 2008/0306799 | A1 * | 12/2008 | Sopko et al. | 705/8 |
| 2009/0192945 | A1 * | 7/2009 | Perpina et al. | 705/80 |
| 2010/0049593 | A1 * | 2/2010 | Du Preez et al. | 705/10 |
| 2010/0241482 | A1 * | 9/2010 | Knyphausen et al. | 705/8 |

OTHER PUBLICATIONS

Top Online Referral Services Help Homeowners Find Reputable Contractors. Anonymous. PR Newswire [New York] Jan. 30, 2008.*

* cited by examiner

*Primary Examiner* — William Allen
(74) *Attorney, Agent, or Firm* — Steven R. Sponseller; Stevens Law Group

(57) ABSTRACT

A bid processing system receives a project description and a baseline estimate for the project. The project is opened for bidding to multiple potential bidders. Each of the potential bidders have access to the project description and the baseline estimate for the project. The bid processing system receives multiple bids for the project and calculates a bid value associated with each of the multiple bids. The system then determines a best bid value from the plurality of received bids and awards the project to the bidder associated with the best bid value.

17 Claims, 7 Drawing Sheets

METHODS AND SYSTEM FOR MAKING A PROJECT AVAILABLE FOR BIDDING TO A PLURALITY OF QUALIFIED POTENTIAL BIDDERS

TECHNICAL FIELD

The present invention relates to systems and methods that handle one or more bids for a product, service, project, or other request.

BACKGROUND

In many situations, an individual or an entity desires to receive bids for a particular project, service, product, or other activity. In these situations, multiple bidders (such as service providers or product providers) may bid on a particular project. An individual or entity that is inexperienced with the bidding process may not understand how to prepare a project description or how to manage the bidding process. Further, inexperienced individuals or entities may not understand how to evaluate the received bids to select a bid having a best value from a properly qualified bidder.

Although existing systems are available for referring service providers to people seeking their service, these existing systems do not provide the bid processing activities discussed herein. The existing systems merely provide a "matching" service between, for example, a contractor and an individual or entity needing contracting services. These systems do not assist the individual or entity with respect to qualifying contractors, evaluating bids, and preparing a project description.

BRIEF DESCRIPTION OF THE DRAWINGS

Similar reference numbers are used throughout the figures to reference like components and/or features.

DETAILED DESCRIPTION

The systems and methods described herein manage a bid processing system that receives project information from project sponsors and receives bids from one or more bidders. Additionally, the bid processing system interacts with other individuals or entities, such as project estimators, warranty providers, escrow services and credentialing services. The bid processing system also allows bidders to bid on an entire project or bid on a portion of a particular project. A "winning" bidder is selected based on a "best value bid", which is not necessarily the lowest bid.

A particular example discussed herein refers to a bid processing system that manages project information and bids associated with a construction project, such as constructing a new building, remodeling an existing structure, creating an addition to an existing building, and the like. This example is provided for purposes of illustration. The systems and methods described herein can be applied to processing bids in any type of environment and for any type of project.

As used herein, the term "project" refers to any activity, event, action, product, service or other item on which a bid may be placed. A specific project can have multiple portions or components. In this situation, bids can be received for the entire project or for one or more portions or components of the project.

A "project sponsor" is any person or entity that describes a particular project. The person or entity may be the end user that receives the benefit of the completed project or another person or entity acting on behalf of the end user. A "bidder" is any person or entity that places a bid on an entire project or on a portion or component of a project. The bidder may be the person or entity that intends to complete the project requirements or another person or entity acting on behalf of the person or entity that will actually complete the project requirements. For example, a general contractor can bid on a particular project with the intention of hiring one or more sub-contractors to complete some or all of the project requirements.

Figure 1:
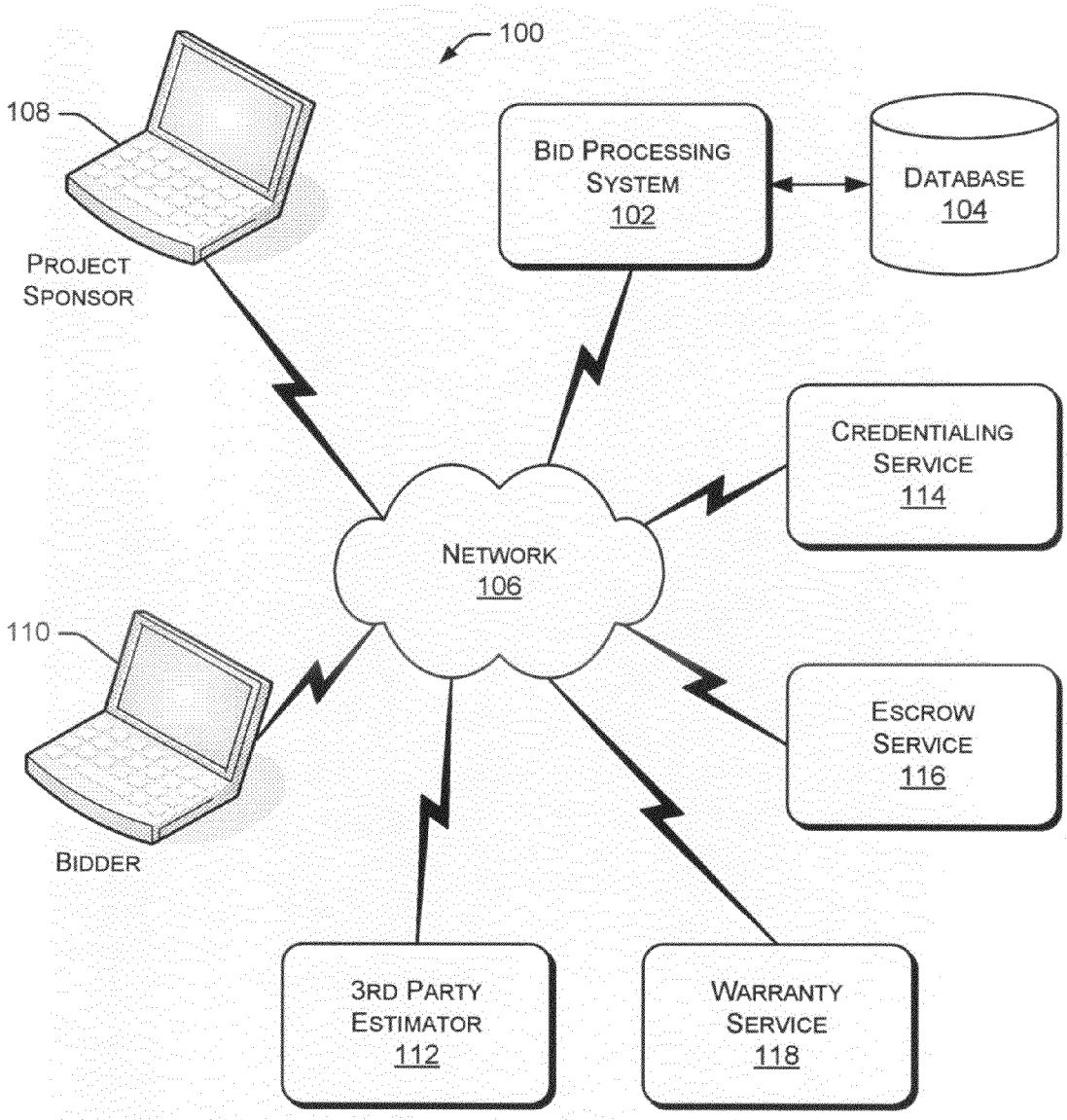
FIG. 1 illustrates an example environment in which the systems and methods discussed herein can be implemented.

FIG. 1 illustrates an example environment 100 in which the systems and methods discussed herein can be implemented. Environment 100 includes a bid processing system 102 coupled to a database 104. Bid processing system 102 performs various bid management and bid processing activities, such as receiving project definitions, receiving bids, managing bidding deadlines, calculating a "best value" bid, storing data to database 104, retrieving data from database 104, and monitoring activities performed by other systems or entities, such as credentialing services, escrow services, warranty services, estimator services, and the like. Bid processing system 102 may also perform additional functions related to bid processing and other tasks.

Database 104 stores various data, such as project data, bidder information, bid data, and the like. In a particular embodiment, database 104 stores information related to multiple projects, including current projects receiving bids, projects that are "in process", and past projects that are complete. Although database 104 is shown in FIG. 1 as being coupled directly to bid processing system 102, in alternate embodiments, database 104 may also be coupled to bid processing system 102 via a data communication network or other communication mechanism.

Network 106 is a data communication network capable of communicating data between devices coupled to the network. Network 106 may utilize any data communication protocol across any type of medium. In a particular embodiment, network 106 is the Internet. In other embodiments, network 106 is a combination of one or more networks, such as wide area networks, local area networks, and the like.

Environment 100 also includes a project sponsor 108, which may be an individual or an entity. As mentioned above, a project sponsor is any person or entity that describes a particular project. The project description may include details regarding the work to be performed (e.g., the scope of the project), start dates and end dates for the project and/or various phases of the project, specifications for materials and/or procedures to be used in completion of the project, location of the project, whether the project can be bid upon in portions, and so forth. In the example of FIG. 1, project sponsor 108 provides project information to bid processing system 102 via a computer coupled to network 106. Example project information includes diagrams, photographs, location, materials, estimates received, and related information. Project information can be generated using a computer-based estimating application, such as Xactimate® available from Xactware Solutions, Inc.

Environment 100 also includes a bidder 110, which is any person or entity that places a bid on an entire project or on a portion or component of a project. As discussed herein, a bidder must be qualified before they are permitted to bid on a project. Once qualified, bidder 110 can search for projects and receive project descriptions for one or more projects by interacting with bid processing system 102. After reviewing project information, bidder 110 can place a bid on a project or a portion of a project.

In the example of FIG. 1, bidder 110 communicates with bid processing system 102 via a computer coupled to network 106. Although one project sponsor 108 and one bidder 110 are shown in FIG. 1, actual embodiments may include any number of project sponsors and any number of bidders coupled to bid processing system 102 via network 106.

Environment 100 also includes a 3rd party estimator 112, a credentialing service 114, an escrow service 116, and a warranty service 118, all of which are coupled to network 106. 3rd party estimator 112 creates a "baseline estimate" for the project. The "baseline estimate" is a complete detailed line item estimate for completing a particular project. The baseline estimate typically includes diagrams, photographs, dimensions and other measurements, and any other information needed to explain the scope of the project. The baseline estimate may also include notes from 3rd party estimator 112 regarding the project. This baseline estimate becomes part of the project description and can be reviewed by bidders prior to placing their bid on a particular project. Multiple estimators are typically used to generate baseline estimates for different types of services and/or products, depending on the expertise of the estimator.

Credentialing service 114 (also referred to as a qualifying service) provides credentialing guidelines, verifies licenses and bidder information, and so forth to ensure that certain service providers meet certain experience and/or competency requirements. For example, building contractors may be credentialed by the U.S. Contractor Certification Network. If a particular contractor does not have the credentials required by bid processing system 102 and/or the credentials specified by project sponsor 108, the bid processing system may not allow that contractor to bid on projects until the necessary credentials are obtained. Credentialing service 114 also manages periodic renewals of contractor credentials and investigates complaints associated with contractors. Multiple credentialing services can be used to provide credentials for bidders in various industries. Additional information regarding the qualifying of bidders is discussed herein with respect to FIG. 4.

Escrow service 116 collects finds from project sponsors and distributes funds to the winning bidder as a project is completed. For example, an escrow service may collect funds from a project sponsor to cover the costs associated with the project. Depending on the complexity of the project, and the find distribution procedures described in the project, the contractor performing the project may receive the finds in multiple payments, each payment being received upon proof of completion of a corresponding portion of the project. This proof of completion may include an on-site progress inspection and/or a final inspection by a 3rd party inspection service. Thus, escrow service 116 protects the project sponsor (ensuring that the work is performed before funds are released) and protects the contractor by ensuring that the contractor is paid for their services in a timely manner.

Warranty service 118 provides a warranty to the project sponsor for products or services provided by a winning bidder. Multiple warranty services can be used to provide warranties for different types of services and/or products.

Figure 2:
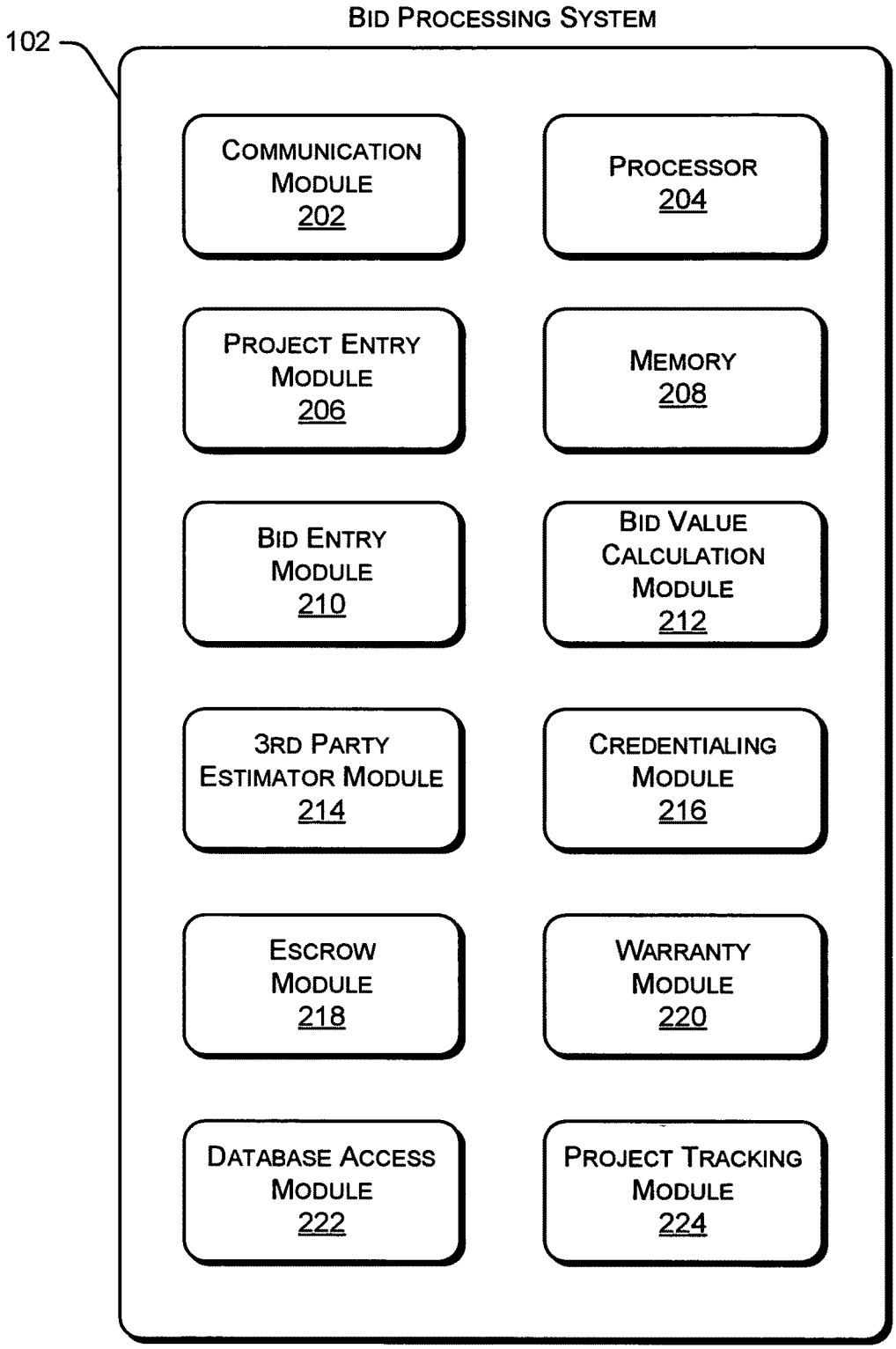
FIG. 2 is a block diagram of an example bid processing system capable of managing bids as discussed herein.

The illustration in FIG. 1 is provided as an example. A particular environment 100 may include any number of bid processing systems 102, databases 104, project sponsors 108, bidders 110, and other services and entities 112-118 coupled to one another via any number of data communication networks and other communication mechanisms. Environment 100 may include additional devices and/or services not shown in FIG. 1, and may eliminate one or more devices and/or services shown in FIG. 1. FIG. 2 is a block diagram of example bid processing system 102 capable of managing bids as discussed herein. Bid processing system 102 includes a communication module 202, a processor 204, a project entry module 206, and a memory 208. Communication module 202 provides data communication with other devices and networks, such as network 106 shown in FIG. 1. Processor 204 performs various operations to implement the features of bid processing system 102. Project entry module 206 provides an interface that allows project sponsors 108 to enter project descriptions and other information associated with a project. Memory 208 includes one or more volatile and/or non-volatile memory devices. Memory 208 stores data used by processor 204 and other components included in bid processing system 102.

Bid processing system 102 also includes a bid entry module 210 and a bid value calculation module 212. Bid entry module 210 provides an interface that allows bidder 110 to search for projects of interest to the bidder. For example, a particular bidder may search for projects in a particular geographic area and involving a certain set of skills, such as a framing project or a roofing project. Bid entry module 210 also allows bidder 110 to obtain project descriptions and other information associated with one or more projects. Bidder 110 can submit bids for one or more projects through bid entry module 210. Additionally, bidder 110 can subscribe to automatically receive alerts via email, text message, or other communication mechanism when new projects in their geographic area and/or area of expertise are made available for bidding. Bid value calculation module 212 calculates a "bid value" associated with each received bid. The "bid value" may consider several factors, such as the amount of the bid, the bidder's experience, the bidder's credentials, and so forth.

Bid processing system 102 further includes a 3rd party estimator module 214, a credentialing module 216, an escrow module 218, and a warranty module 220. 3rd party estimator module 214 interacts with one or more 3rd party estimators (or estimator service providers), as discussed herein. Credentialing module 216 (also referred to as a "qualifying module") interacts with one or more credentialing service providers, as discussed herein. Escrow module 218 interacts with one or more escrow service providers, as discussed herein. Warranty module 220 interacts with one or more warranty service providers, as discussed herein.

Bid processing system 102 also includes a database access module 222 and a project tracking module 224. Database access module 222 manages the retrieval of data from database 104 and the storage of data to database 104. Project tracking module 224 monitors the status of one or more projects. For example, project tracking module 224 monitors the level of completion for each project (started, awaiting inspection, finished, etc.), the contractor responsible for the project, the next action to be completed for the project, and the like. Project tracking module 224 communicates with escrow module 218 regarding project updates and modifications.

In alternate embodiments of bid processing system 102, additional components may be added to the system and one or more components shown in FIG. 2 may be removed from the system. For example, warranty module 220 may be removed from bid processing system 102 if warranty services are not offered to project sponsors. Additionally, modules to communicate with other service providers may be added to bid processing system 102, as appropriate.

Figure 3A:
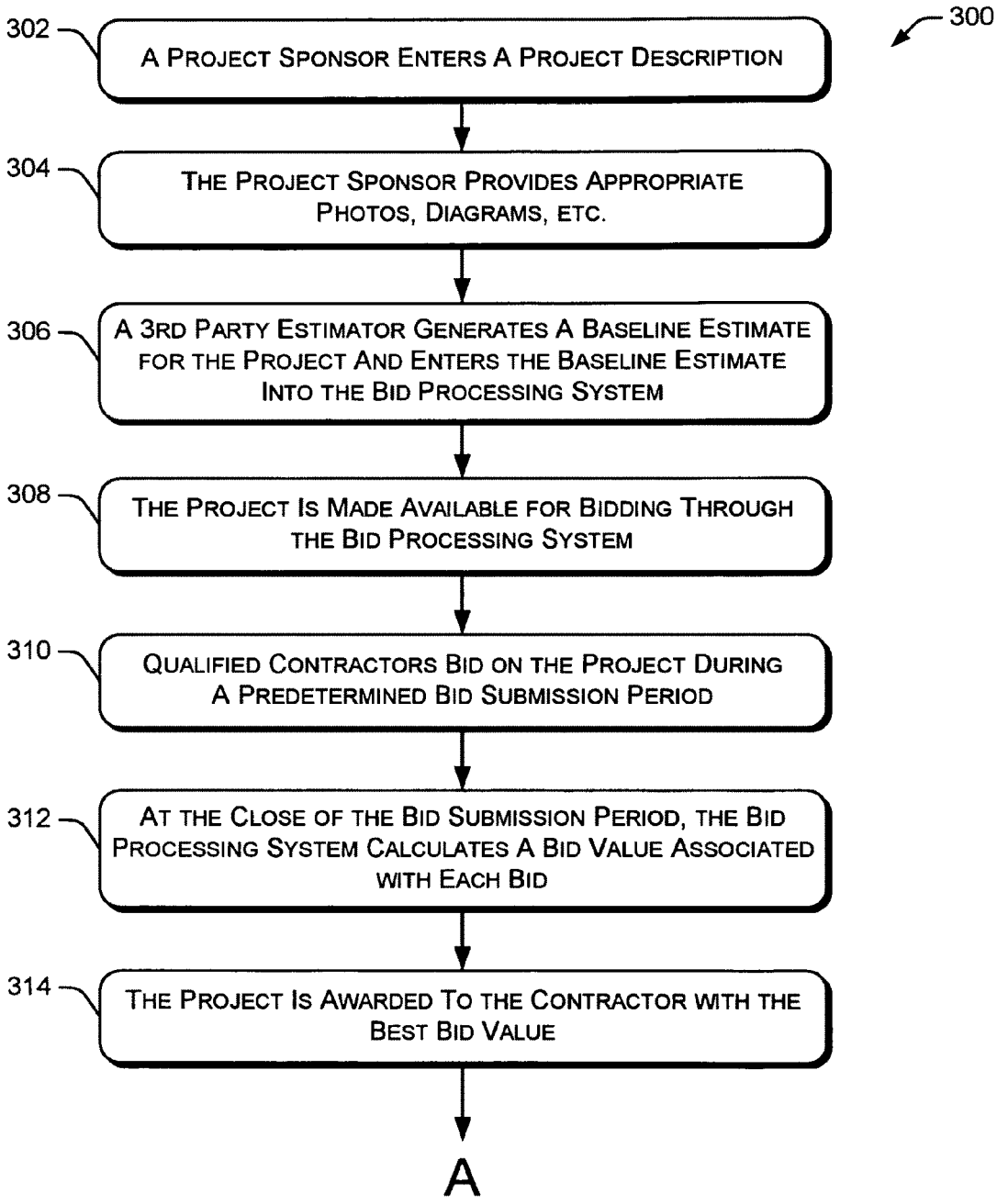
FIGS. 3A and 3B present a flow diagram illustrating an example procedure for defining a project and processing bids associated with that project.
Figure 3B:
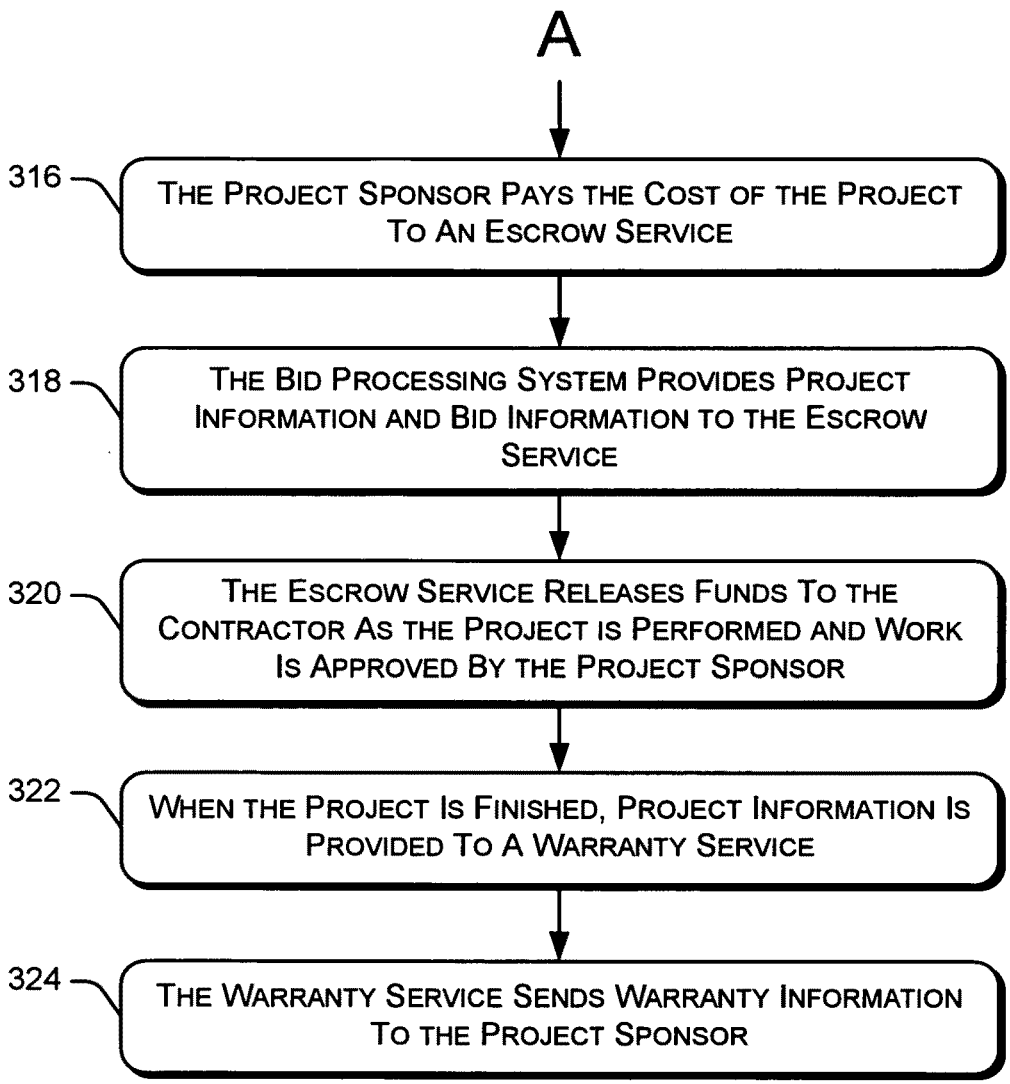

FIGS. 3A and 3B present a flow diagram illustrating an example procedure 300 for defining a project and processing bids associated with that project. Referring to FIG. 3A, procedure 300 begins when a project sponsor enters a project description (block 302). As discussed herein, a project description includes details regarding the work to be performed, start date, end date, bidding deadline, materials and/or procedures, geographic location, and the like. The project sponsor then provides photographs, diagrams, and any other items that are appropriate to assist bidders in developing a bid for the particular project (block 304).

The procedure continues as a 3rd party estimator generates a baseline estimate for the project and enters that baseline estimate into the bid processing system (block 306). The 3rd party estimator generates the baseline estimate by reviewing the project description and related photographs, diagrams, and so forth. Additionally, the 3rd party estimator may visit the project site and may consult with other resources in generating the baseline estimate. The baseline estimate is a guideline for use by the bidders and is not binding on either the project sponsor or the bidders.

Next, the project is made available for bidding through the bid processing system (block 308). Qualified contractors can access the project description, the baseline estimate, and related items. Qualified contractors are able to bid on the project during a predetermined bid submission period (block 310). The bid submission period is typically specified by the project sponsor. At the close of the bid submission period, the bid processing system calculates a bid value associated with each bid (block 312). After calculating the bid values, the project is awarded to the contractor with the best bid value (block 314).

Procedure 300 continues as the project sponsor pays the cost of the project to an escrow service (block 316). In one embodiment, this cost is equal to the winning bid amount. In alternate embodiments, the project sponsor pays the cost of the project into escrow in multiple payments that correspond to various phases of the project. The bid processing system provides project information and bid information to the escrow service (block 318). The escrow service then releases finds to the contractor as the project is performed and work is approved by the project sponsor or another person or entity (block 320). The project description typically describes the manner in which funds are released to the bidder based on completing various portions of the project. Thus, the bidder knows this payment structure prior to bidding on the project.

When the project is finished, the project information is provided to a warranty service (block 322). The warranty service then sends warranty information to the project sponsor (block 324). If the project sponsor discovers an issue covered by the warranty, the project sponsor contacts the warranty service to resolve the issue.

In a particular embodiment, revenue is collected from both the project sponsors and the bidders based on their usage of the bid processing system. For example, project sponsors and/or bidders may pay a periodic membership fee to have access to the bid processing system. Additionally, a fee may be charged to the project sponsor when a bid is accepted for the sponsor's project. Another fee may be charged to the winning bidder of each project. Certain services (such as an escrow service or a warranty service) may have an additional associated fee. Fees may be flat-rate fees or may be based on the type of project, the estimated cost of the project, or the amount of the successful bid. In alternate embodiments, other revenue models may be implemented that charge the project sponsors and/or the bidders.

Figure 4:
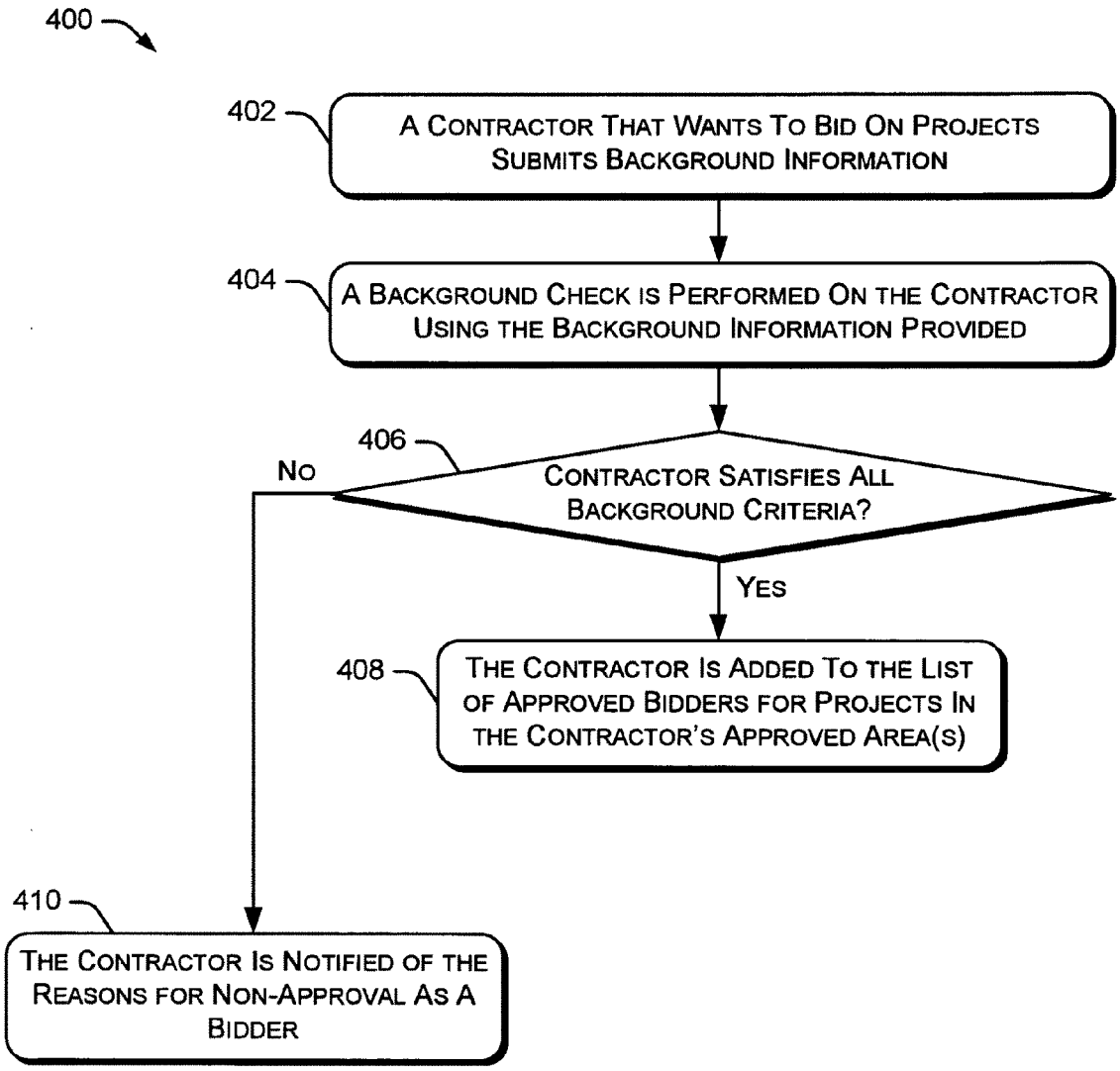
FIG. 4 is a flow diagram illustrating an example procedure for qualifying a bidder.

FIG. 4 is a flow diagram illustrating an example procedure 400 for qualifying a bidder. Initially, a contractor that wants to bid on one or more projects submits background information (block 402). Example background information includes the number of years doing similar work, insurance policies and coverages for the contractor, Dun and Bradstreet rating, licenses (including license expiration date), social security number and/or driver's license number for performing criminal background checks, and a copy of the contractor's written warranty provided for all work performed by the contractor. Next, a background check is performed on the contractor using the background information provided (block 404). The background check includes, for example, a criminal background check, review of insurance policies, review of Dun and Bradstreet information, licensing status and past licensing revocations, and review of the warranty provided by the contractor.

In a particular embodiment, a minimum threshold is required for each item of background information. If the contractor fails to satisfy the threshold requirements for any item, the contractor is not approved. Thus, project sponsors know that all approved bidders meet these minimum requirements. For example, a threshold for the minimum years of experience doing similar work is five years, certain insurance policies with specific coverage levels are required, there must be no license revocations within the past three years, no criminal convictions within the last ten years, and the contractor's written warranty must be at least one year. In other embodiments, different threshold levels are used depending on the size, cost, or complexity of the project. For example, a higher threshold may be required for projects with an estimated cost over $100,000 as compared to projects with an estimated cost under $10,000. Additionally, a complex project may require more experience with similar projects and higher insurance coverages.

Procedure 400 continues by determining whether the contractor satisfies all background criteria (block 406). If the contractor satisfies all background criteria (e.g., meets or exceeds all thresholds), the contractor is added to the list of approved bidders for projects in the contractor's approved area(s) (block 408). For example, a contractor may be approved for bidding on projects related to framing and roofing work, but not approved for other types of work (e.g., electrical or plumbing work). If the contractor fails to satisfy one or more of the background criteria, procedure 400 branches from block 406 to block 410, where the contractor is notified of the reasons for failing to be approved as a bidder.

Once a contractor is approved as a bidder, the contractor is "re-qualified" on a periodic basis, such as annually. The re-qualification process typically performs the same steps as discussed with respect to procedure 400, using updated background information. Additionally, once a contractor is approved as a bidder, the contractor's performance is monitored on a regular basis. In one example, the contractor is required to maintain a certain "project rating" with respect to various factors, such as timeliness, proper communication with the project sponsor and/or insurance carrier, maintain an acceptable re-inspection rating of the work performed (during and after the project), and receive acceptable survey results from project sponsors. If the contractor's project rating falls below a particular threshold (e.g., 80% acceptance/satisfaction), the contractor may be prevented from bidding on new projects until the project rating is improved or the problems causing the unacceptable project rating are corrected.

In a particular embodiment, a contractor's project rating is calculated using a weighted formula, such that different components of the formula have varying levels of importance. For example, if the project rating is calculated from four factors (such as timeliness, communication, inspection and survey results), one of the factors may have a weighting of 35% (very important), another factor has a weighting of 25%, and the remaining two factors have a 20% weighting (less important). The weighted formula has a default weighting for each of these factors which may be changed by a user or system administrator to meet the preferences of a particular client or customer.

Figure 5:
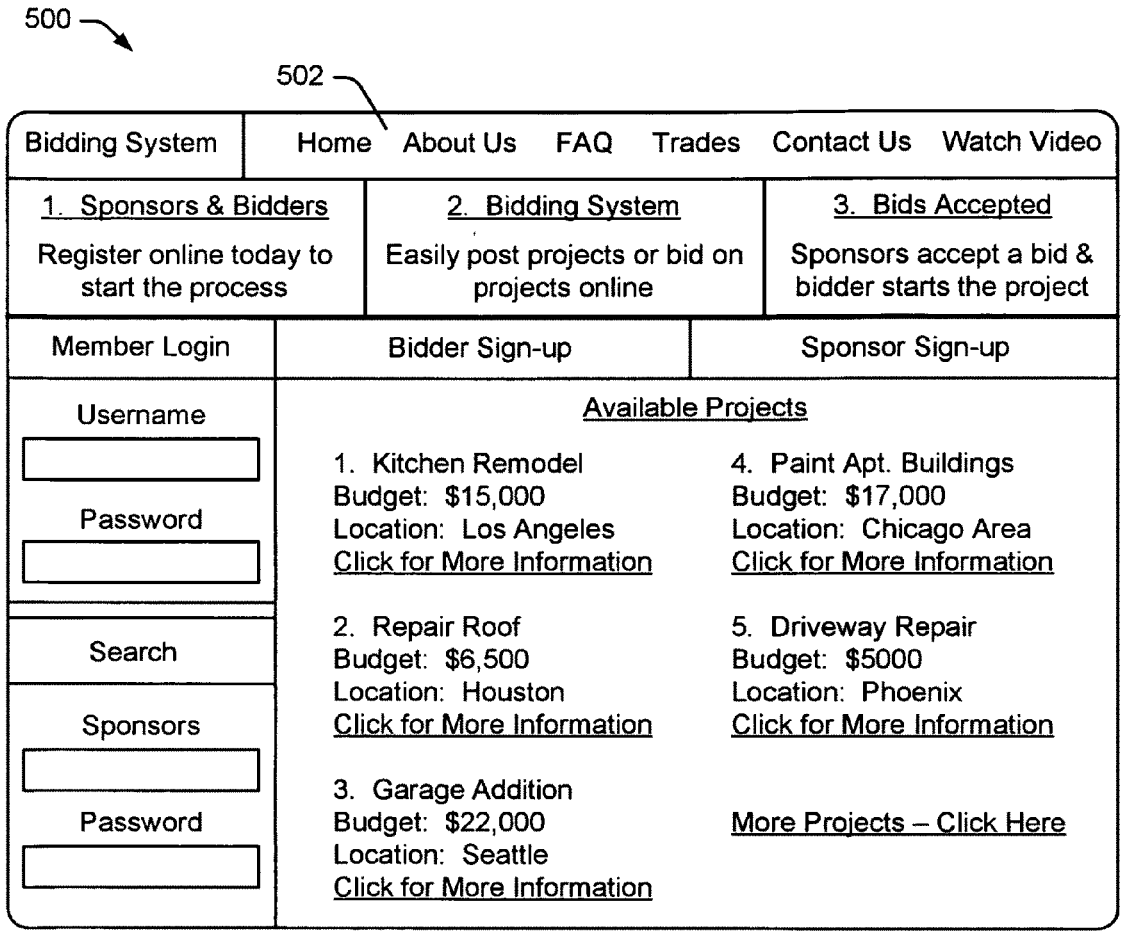
FIG. 5 illustrates an example user interface that allows project sponsors, project bidders and other users to interact with the bid processing system.

FIG. 5 illustrates an example user interface 500 that allows project sponsors, project bidders and other users to interact with the bid processing system. User interface 500 includes a menu bar 502 across the top of the user interface. In this example, menu bar 502 includes links to a "Home" page (the page shown in FIG. 5), an "About Us" link that displays information about the bidding system/service, a "FAQ" link that displays answers to frequent questions about the bidding system/service, a "Trades" link that displays information relating to various job categories and related trade information, a "Contact Us" link that displays contact information for the bidding service provider, and a "Watch Video" link that launches a video demonstrating and describing the bidding system/service. In alternate embodiments, menu bar 502 may include any number of links that provide any type of information that might be of interest to a user of the bid processing system.

User interface 500 also provides links to additional information regarding the three basic steps in the bidding process: 1. Registering as a project sponsor or bidder, 2. Posting projects or bidding on projects, and 3. Accepting a bid for a project. Clicking on any of these three steps will display a new screen with additional information related to the selected step. Additionally, user interface 500 includes a member login feature for project sponsors and bidders to login to their account. A search feature allows users to search for projects, bidders, project sponsors, or other information.

User interface 500 further includes a "Bidder Sign-up" link and a "Sponsor Sign-up" link that allow users to sign up as bidders or sponsors, respectively. The example of FIG. 5 also includes an "Available Projects" section that displays a summary of several projects available for bidding. A user can click on a link associated with each project to get additional project details. A "More Projects" link displays a new screen containing additional projects available for bidding.

In alternate embodiments, additional information and/or features are displayed via user interface 500. Alternately, one or more sections and/or features shown in FIG. 5 may be deleted from different embodiments of the interface. Other user interface screens (not shown) may include information such as detailed project information (e.g., diagrams, photos, or 3rd party estimates), specific bidder information (e.g., credentials, description of work experience, links to completed projects, references, or testimonials), bidder qualification requirements, escrow service details, warranty information and the like.

In another example, the systems and methods described herein are useful in providing temporary housing to individuals and/or entities. In this example, a project description identifies the type of housing desired (number of bedrooms, type of housing, and the like), the number of housing units needed, the time period during which the housing is desired, and so forth. The potential bidders for this project include hotel owners/managers, apartment owners/managers, property rental services, and related individuals and entities that own or manage housing units. The bidders are qualified as discussed above. For example, housing units may be inspected, bidder licenses verified, and the like. The systems and methods described herein assist the individual or entity needing temporary housing by providing a bidding process to receive competitive bids from qualified bidders. These systems and methods also assist the owner or manager of the housing units by offering multiple projects to absorb their vacant housing units.

In an alternate embodiment, a project sponsor may post multiple jobs that are similar to one another as a single project. For example, if an insurance company needs to have the roofs of several hundred homes repaired after a storm (e.g., a hail storm or wind storm), the insurance company can create a single project that requests bids on repairing roofs on 300 homes. In this example, a contractor can bid on all 300 jobs, or bid on a smaller number of jobs, such as 25 roof repair jobs. The insurance company typically sets the manner in which the bids are calculated. In the above example, bidders can bid on a cost per roof, per shingle, per square foot, and so forth.

Figure 6:
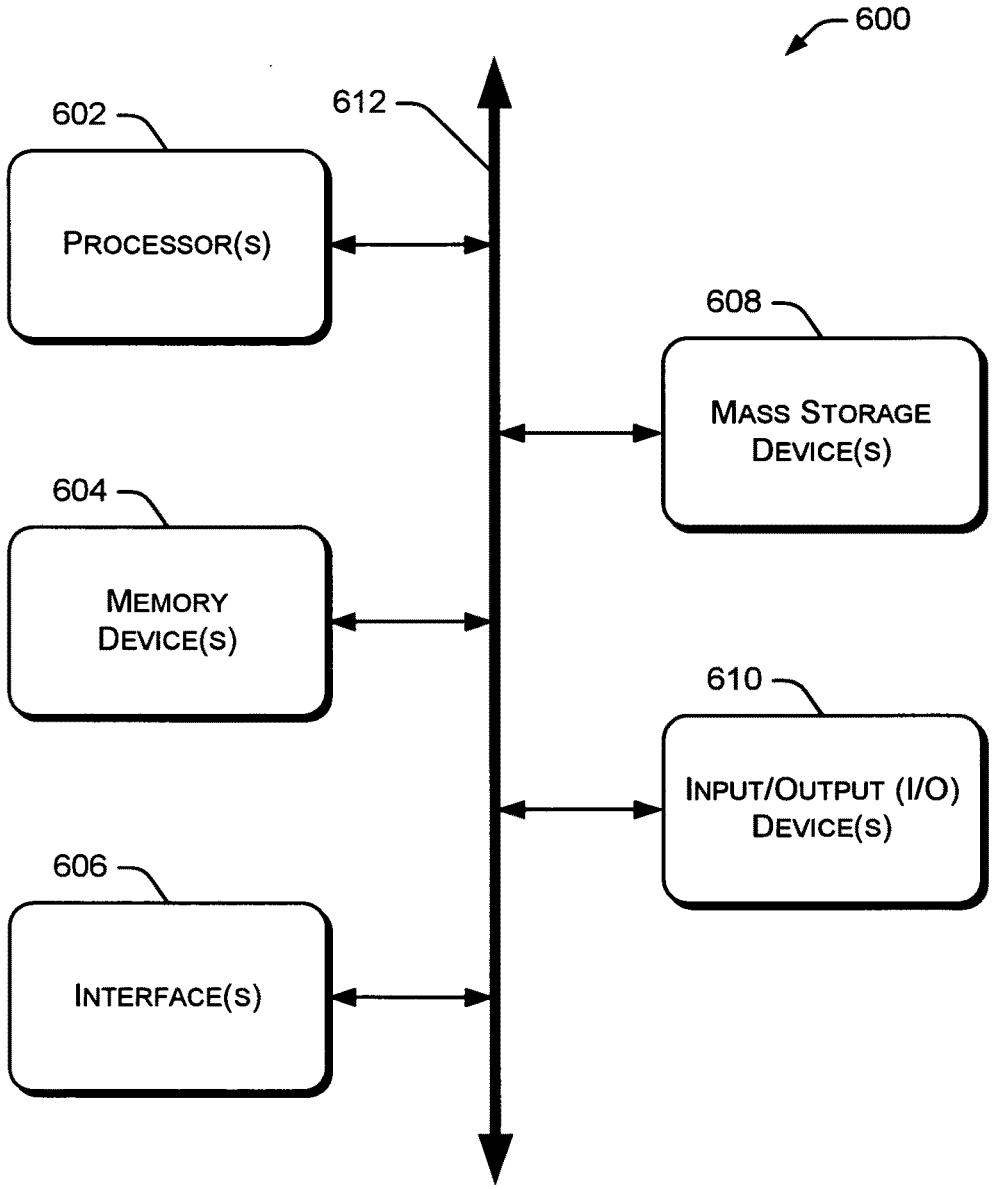
FIG. 6 is a block diagram illustrating an example computing device.

FIG. 6 is a block diagram illustrating an example computing device 600. Computing device 600 may be used to perform various procedures, such as those discussed herein. Computing device 600 can function as a server, a client, or any other computing entity. Computing device 600 can be any of a wide variety of computing devices, such as a desktop computer, a notebook computer, a server computer, a handheld computer, and the like.

Computing device 600 includes one or more processor(s) 602, one or more memory device(s) 604, one or more interface(s) 606, one or more mass storage device(s) 608, and one or more Input/Output (I/O) device(s) 610, all of which are coupled to a bus 612. Processor(s) 602 include one or more processors or controllers that execute instructions stored in memory device(s) 604 and/or mass storage device(s) 608. Processor(s) 602 may also include various types of computer-readable media, such as cache memory.

Memory device(s) 604 include various computer-readable media, such as volatile memory (e.g., random access memory (RAM)) and/or nonvolatile memory (e.g., read-only memory (ROM)). Memory device(s) 604 may also include rewritable ROM, such as Flash memory.

Mass storage device(s) 608 include various computer readable media, such as magnetic tapes, magnetic disks, optical disks, solid state memory (e.g., Flash memory), and so forth. Various drives may also be included in mass storage device(s) 608 to enable reading from and/or writing to the various computer readable media. Mass storage device(s) 608 include removable media and/or non-removable media.

I/O device(s) 610 include various devices that allow data and/or other information to be input to or retrieved from computing device 600. Example I/O device(s) 610 include cursor control devices, keyboards, keypads, microphones, monitors or other display devices, speakers, printers, network interface cards, modems, lenses, CCDs or other image capture devices, and the like.

Interface(s) 606 include various interfaces that allow computing device 600 to interact with other systems, devices, or computing environments. Example interface(s) 606 include any number of different network interfaces, such as interfaces to local area networks (LANs), wide area networks (WANs), wireless networks, and the Internet.

Bus 612 allows processor(s) 602, memory device(s) 604, interface(s) 606, mass storage device(s) 608, and I/O device(s) 610 to communicate with one another, as well as other devices or components coupled to bus 612. Bus 612 represents one or more of several types of bus structures, such as a system bus, PCI bus, IEEE 1394 bus, USB bus, and so forth.

For purposes of illustration, programs and other executable program components are shown herein as discrete blocks, although it is understood that such programs and components may reside at various times in different storage components of computing device 600, and are executed by processor(s) 602. Alternatively, the systems and procedures described herein can be implemented in hardware, or a combination of hardware, software, and/or firmware. For example, one or more application specific integrated circuits (ASICs) can be programmed to carry out one or more of the systems and procedures described herein.

Although the description above uses language that is specific to structural features and/or methodological acts, it is to be understood that the invention defined in the appended claims is not limited to the specific features or acts described. Rather, the specific features and acts are disclosed as exemplary forms of implementing the invention.

The invention claimed is:

1. A method comprising:

receiving a project description;

receiving a baseline estimate for the project, wherein the baseline estimate for the project is created by a non-bidding third party estimator;

making the project available for bidding to a plurality of potential bidders, each of the plurality of potential bidders being qualified by a credentialing service prior to receiving the project description, the plurality of qualified bidders having access to the project description and the baseline estimate prior to placing a bid for the project;

receiving a plurality of bids for the project from the qualified bidders;

determining, using one or more processors, a best bid value from the plurality of received bids; and awarding the project to a bidder associated with the best bid value.

2. A method as recited in claim 1 further comprising communicating the project description, best bid value, and an identity of the bidder associated with the best bid value to an escrow service.

3. A method as recited in claim 1 wherein qualifying each potential bidder includes at least one of performing a criminal background check on the potential bidder, verifying the potential bidder's experience with a particular type of project, verifying the potential bidder's license status, and reviewing the potential bidder's warranty.

4. A method as recited in claim 1 further comprising re-qualifying each of the potential bidders at predetermined time intervals.

5. A method as recited in claim 1 further comprising maintaining a project rating for each of the potential bidders by monitoring the performance of each of the potential bidders.

6. A method as recited in claim 5 wherein maintaining a project rating for each of the potential bidders includes determining the timeliness with which projects are completed by the potential bidder.

7. A method as recited in claim 5 wherein maintaining a project rating for each of the potential bidders includes determining the work quality performed by the potential bidder.

8. A method as recited in claim 5 wherein maintaining a project rating for each of the potential bidders includes receiving survey results associated with the potential bidder's work from project sponsors.

9. A method comprising:

identifying a plurality of qualified bidders, the qualified bidders being previously qualified by a credentialing service;

receiving a description of a project from a project sponsor;

receiving a baseline estimate for the project from the project sponsor, the baseline estimate including an estimated cost to complete the project, wherein the baseline estimate for the project is created by a non-bidding third party estimator;

receiving requests to bid on the project from the plurality of qualified bidders;

making the project available for bidding to the qualified bidders, the qualified bidders having access to the project description and the baseline estimate;

receiving a plurality of bids for the project from the qualified bidders; and determining, using one or more processors, a winning bid from the plurality of received bids.

10. A method as recited in claim 9 further comprising communicating the project description, the winning bid, and an identity of the bidder associated with the winning bid to an escrow service.

11. A method as recited in claim 9 further comprising communicating the project description, an identity of the project sponsor, and an identity of the bidder associated with the winning bid to a warranty service.

12. A method as recited in claim 9 wherein identifying a plurality of qualified bidders includes at least one of performing a criminal background check on the qualified bidder, verifying the qualified bidder's license status, verifying the qualified bidder's experience with a particular type of project, and reviewing the qualified bidder's warranty.

13. A method as recited in claim 9 further comprising maintaining a project rating for each qualified bidder by monitoring the project performance of each qualified bidder.

14. A method as recited in claim 13 wherein maintaining a project rating for each qualified bidder includes one of determining the timeliness with which projects are completed by the qualified bidder and determining the work quality performed by the qualified bidder.

15. A bid processing system comprising:

a memory to store data associated with a project; and one or more processors coupled to the memory, the one or more processors configured to:

receive a project description and a baseline estimate for the project, wherein the baseline estimate for the project is received from a non-bidding third party estimator;

identify a plurality of qualified bidders for the project by receiving credentialing information from a credentialing service;

make the project available for bidding to the plurality of previously qualified bidders, the plurality of previously qualified bidders having access to the project description and the baseline estimate prior to placing a bid for the project;

receive a plurality of bids for the project; and determine a winning bid from the plurality of received bids for the project.

16. A bid processing system as recited in claim 15 wherein the one or more processors are further configured to communicate the project description, the winning bid, and an identity of the bidder associated with the winning bid to an escrow service.

17. A bid processing system as recited in claim 15 wherein the one or more processors are further configured to maintain a project rating for each of the qualified bidders.

* * * * *